US005661653A

United States Patent [19]

Kulik

[11] Patent Number: 5,661,653

[45] Date of Patent: Aug. 26, 1997

[54] CUSTOM CLASS SELECTION IN AUTOMATED MAIL PROCESSING

[75] Inventor: George Kulik, Trumbull, Conn.

[73] Assignee: Pitney Bowes Inc., Stamford, Conn.

[21] Appl. No.: 610,003

[22] Filed: Mar. 4, 1996

[51] Int. Cl.[6] ..... G07B 17/00

[52] U.S. Cl. ..... 364/464.2; 364/400; 395/611; 395/615

[58] Field of Search ..... 177/25.15; 209/584, 209/900; 364/400, 464.02, 464.03, 464.2; 395/611, 615

[56] References Cited

U.S. PATENT DOCUMENTS

| | | | |
|---|---|---|---|
| 4,313,508 | 2/1982 | Duppre | 177/25.15 |
| 4,320,461 | 3/1982 | Dlugos | 364/464.02 |
| 4,430,716 | 2/1984 | Dlugos et al. | 364/464.03 |
| 4,495,581 | 1/1985 | Piccione | 364/464.03 |
| 4,506,330 | 3/1985 | Dlugos | 364/464.03 |
| 5,293,310 | 3/1994 | Carroll et al. | 395/214 |
| 5,337,246 | 8/1994 | Carroll et al. | 364/464.02 |
| 5,444,630 | 8/1995 | Dlugos | 364/464.02 |

*Primary Examiner*—Edward R. Cosimano
*Attorney, Agent, or Firm*—Angelo N. Chaclas; Melvin J. Scolnick

[57] ABSTRACT

A program controlled automatic mail processor includes custom rates software to facilitate processing of mixed mail streams for posting via a plurality of classes, without manual sorting of the mail into classes or manual selection of classes during mail processing. A user defines a custom rates template, specifying classes and break point parameters (e.g. weight values) for controlling shifts between the selected classes. The mail processor uses the template and previously stored standard postage rate tables to develop a custom rates rate table for processing mail in multiple classes. Once the custom rates rate table is established, an operator can select any table from among the standard tables and one or more such custom rates rate tables. The operator then begins feeding mail through the mail processor. The mail processor checks a parameter value (e.g. weight) of each piece of mail and applies the appropriate postage value from the currently selected table. In particular, if the user selects a custom rates rate table, the mail processes pieces of mail in a single stream in multiple mail classes, using class break point or classification information and corresponding rate information from the custom rates rate table.

17 Claims, 3 Drawing Sheets

CUSTOM CLASS SELECTION IN AUTOMATED MAIL PROCESSING

TECHNICAL FIELD

The present invention relates to a mail processing methodology that permits processing of pieces of mail in a single stream using postage rating information relating to a plurality of standardized classes.

BACKGROUND ART

State of the art mail processing machines perform a variety of automated processes to minimize manual mail handling. For example, a PARAGON Mail Processor sold by the assignee of the present application includes a feeder module which auto singulates mail, feeds mixed mail and seals pieces of mail. The PARAGON Mail Processor also includes a base module which contains a control panel, a central processor unit and a weigh-on-the-way mail classifier scale. The base module effectively weighs each piece of mail in a stream and prints appropriate postage based on a selected postage class table. The mail module also includes a postage meter which stores 'electronic cash' used to pay for printed proof of postage indicia. The postage meter also includes a printer to apply the indicia.

A postal authority or alternate mail carrier publishes a series of rate schedules based on a variety of parameters, such as weight, origin and destination and class of mail. The rates charged typically vary for different classes of mail. Automated mail processors store a series of tables corresponding to the published rates. A major advantage of automated mail processors such as the PARAGON is the ability to process a mixed mail stream and automatically apply postage to pieces of mail in the one stream.

However, the mixed mail processing requires manual sorting and class selection. In operation, a user selects a class of mail and feeds in a stream of mail. When the mail processor determines the weight of a piece of mail in the stream, the processor uses the table for the selected class to determine the postage value for that piece of mail. However, the automated processing is limited to the one selected class at any given time. The mail processor will calculate and apply postage to each piece of mail in the input stream using the one selected postage class table until the operator resets the class selection to a new class. Consequently, an operator must sort the mail in advance to insure that all pieces input at any time should be posted within the one selected class. When all pieces of one class have been processed, the operator selects a new class and feeds in mail in the second class for processing.

It is often the case that batch mailers (e.g. phone bills) can fall into different mail classes based on weight or other attributes, such as pre-sorting, pre-barcoding, etc. To process such multi-class streams, however, requires manual pre-sorting into the individual classes as outlined above. Existing automated mail processors do not have the capacity to process pieces of mail in multiple mail classes within a single input stream without manual sorting and class selection.

A need therefore exists for an automated mail processor for applying appropriate postage for pieces of mail from multiple mail classes in a single input stream. A number of prior systems have been developed to provide certain customized rating capabilities, but the prior art systems have not addressed this need.

U.S. Pat. No. 5,337,246 and 5,293,310 both to Carroll et al. disclose an automated system for applying customized rates, i.e. special rates offered by a carrier to an individual customer. A memory stores data security codes, standard rates and data for individual discount rates agreed upon by contract between the carrier and the individual sending the mail. The system accesses the stored data, initially applies the standard rate to a piece of mail and then applies the discount to determine the actual rate.

U.S. Pat. No. 5,444,630 to Dlugos discloses a similar system for calculating and applying customized discount rates. In this system, the processor stores transformation data for a number of levels of discount rates. Each set of transformation data is kept one-to-one with respect to base rate data for a plurality of desired parameters. The transformation data typically varies at different levels, such as date, quantity or dollar value. The processor applies the standard rate to a piece of mail, determines if a trigger condition is met in relation to the defined level parameter, and if triggered applies the discount rate to determine the actual rate.

U.S. Pat. No. 4,320,461 to Dlugos discloses a postage value calculator and printer utilizing a processor and a .memory storing rate chart. Each rate chart includes weight limits, weight increments, the address of a corresponding zip-to-zone conversion table and the address for the next rate chart if article weight exceeds the limit.

U.S. Pat. No. 4,506,330 to Dlugos discloses a parcel processor storing 'custom' zip-to-zone conversion data reflecting postal cost variations within a particular class. A user manually activates a switch to select a memory location storing standard conversion table information and a memory location storing the customized zone conversion data. The system determines the postage for a parcel based on weight, class and selected zone information.

U.S. Pat. No. 4,430,716 to Dlugos et al. discloses a microprocessor based postage rate calculator storing postage rate information in a first PROM and custom rates information in a second PROM. The custom rates information relates to postage rates for mailing from remote locations wherein a unique rate structure applies to that remote point of origin, e.g. as used at the time by United Parcel Service. The system processor accesses the rate data stored in the respective PROMs in response to user inputs of the type of postage to be calculated.

In each of the above prior art systems, a given stream of mail is processed, in accord with one rate table set by the postal authority or carrier, be it a standard rate table or a customized rate table agreed upon between the individual and the carrier. Rates may change at various break points in the process, e.g. for different weights or for different levels, but the class of mail apparently does not change during processing of one unsorted mail stream. It is believed that in each prior art system, processing of a different class of mail would require activation of a different rate table. Accordingly, processing of multiple classes requires sorting mail into respective classes so that mail in each class is processed only while the rate table for the class is actively selected and applied.

DISCLOSURE OF THE INVENTION

One objective of the present invention is to provide a system for calculating and applying postage to pieces of mail within a single stream using postage rate information relating to a plurality of classes of mail, without requiring a manual sorting or manual selection of a class of mail.

It is a further objective of the invention to provide a system wherein the customer can select individual mail classes for processing of mail for different values of one or more parameters, e.g. weight, relating to each piece of mail within the single stream.

The present invention achieves the above stated objectives and overcomes the above described and other problems present in the prior art by permitting the user to develop customized processing information spanning a plurality of user selected mail classes.

In one aspect, the present invention relates to automated mail processing techniques. A user inputs a custom rates template. The template includes a first mail class selection and a corresponding first parameter value and a second mail class selection and a second corresponding parameter value. First postage rate information is obtained from a standard postage rate table for the first selected mail class. The first postage rate information relates to postage applicable to mail posted via the first mail class and having a parameter within a range defined at least in part by the first parameter value. Second postage rate information is obtained from a standard postage rate table for the second class. The second postage rate information relates to postage applicable to mail posted via the second mail class and having a parameter within a range defined at least in part by the second parameter value. The first and second postage rate information is stored as a custom rates rate table.

Subsequently, an automatic mail processor processes a stream of a plurality of pieces of mail in the first and second classes using the custom rates rate table. For example, the mail processor applies postage based on the first postage rate information to a first piece of mail in the stream if that piece of mail has a measured parameter in the range defined at least in part by the first parameter value. Continuing the example, the mail processor applies postage based on the second postage rate information to a second piece of mail in the stream if that piece of mail has a measured parameter in the range defined at least in part by the second parameter value.

Although a number of different parameters may be used to control the ranges for applying postage for the selected classes, in the preferred embodiment, the parameter values relate to ranges of weight of processed pieces of mail. In the above example, the first piece of mail is processed using postage information for the first mail class if the weight of that piece is less than or equal to a first weight break value from the template. The second piece of mail is processed using postage information for the second mail class if the weight of that piece is greater than the first weight break value and less than or equal to the second weight break value.

The present invention also provides an intelligent user interface for input of the user defined template. The mail processor prompts the user for input of class selections and corresponding parameter values. The mail processor determines the validity of the class selections and corresponding parameter values based on the standard postage rate information. The mail processor stores class selections and corresponding parameter values only if found valid.

In another aspect, the present invention relates to an automatic mail processor performing mail processing procedures such as those summarized above. The mail processor includes a scale for weighing pieces of mail and a postage meter for applying postage values to individual pieces of mail. A central processing unit controls operation of the scale and the postage meter. The central processing unit is coupled to a user interface, such as a display and keyboard. A memory stores software controlling operation of the central processing unit. The software includes a weight break table and a rate break table. The weight break table is loadable with data specifying weight indexes used by the scale to classify pieces of mail into weight ranges. The rate break table is loadable with data translating weight ranges into postage values. In the preferred embodiment, the software also includes a rates manager module administering stored rate tables containing standard postage rate information for a plurality of mail classes.

To perform the custom rates processing of the type discussed above, the stored software further includes a custom rates processor module and at least one the user defined custom rates templates. The custom rates software module interacts with the rates manager to access postage rate information in the stored rate table for each mail class specified in the custom rates template and thereby develop and store a custom rates rate table corresponding to the template. An application software module is responsive to a user selection of any one of the stored tables, including both the standard postage rate tables and one or more of the custom rates rate tables. In response to such a selection, the application software module loads information from the selected stored table into the weight break table and the rate break table to control subsequent processing of pieces of mail via the scale and postage meter.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BEST MODE FOR CARRYING OUT THE INVENTION

The present invention contemplates a software controlled mail processor wherein a user can define a custom template, specifying classes and break point parameters for controlling shifts between classes. The processor uses the template and standard rate tables to develop a custom rates rate table for processing mail in multiple classes. Once the custom rates rate table is established, an operator can select any one of the standard tables and one or more such custom rates rate tables. In each case, the mail processor checks a parameter value (e.g. weight) of each piece of mail and applies the appropriate postage value from the currently selected table. If the user selects a custom rates rate table, the mail processes pieces of mail in a single stream in multiple mail classes, using class break point or classification information and corresponding rate information from the custom rates rate table.

The present invention may define shifts or breaks between classes in the templates based on a variety of parameters, such as detected presence or absence of barcoding, size of mail, etc. The mail processor applies postage based in part on the weight of each piece of mail, and in the preferred embodiment, the parameters defining the shifts or break points between classes are also based on the weight of the mail.

Figure 1:
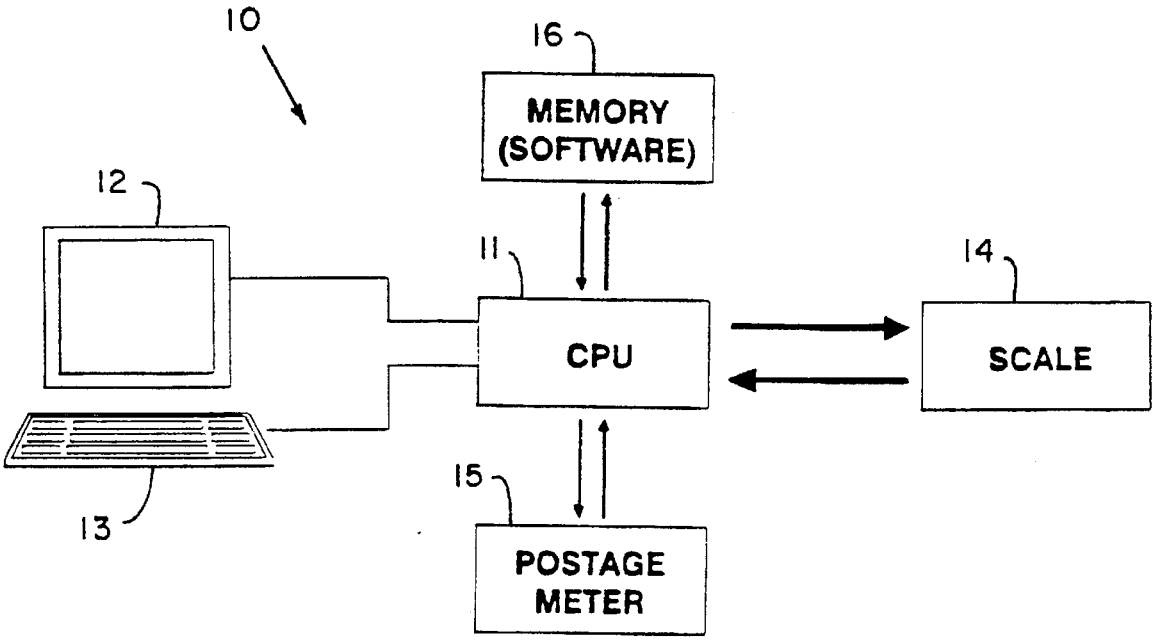
FIG. 1 is a simplified block diagram of a mail processor in accord with the present invention.

FIG. 1 shows the functional elements of a mail processor capable of operating in accord with the present invention. As shown, the mail processor 10 includes a central processing unit (CPU) 11. A keyboard 13 and a display 12 provide a user interface to the CPU 11. The mail processor 10 includes a scale 14 for classifying pieces of mail by weight and a postage meter 15 for applying postage to the pieces of mail and managing the 'electronic cash' for the applied postage. In operation, the postage meter debits the electronic cash value by the applied amount for each individual piece of mail. The CPU 11 controls all operations of the mail processor 10 based on software stored in a non-volatile memory 16.

In the preferred embodiment, the mail processor 10 is a PARAGON Mail Processor marketed by Pitney Bowes, Inc. In that embodiment, the processor 10 will include a number of other system components not shown, such as conveyor and feeder module which auto singulates mail, feeds mixed mail and seals pieces of mail.

Figure 2:
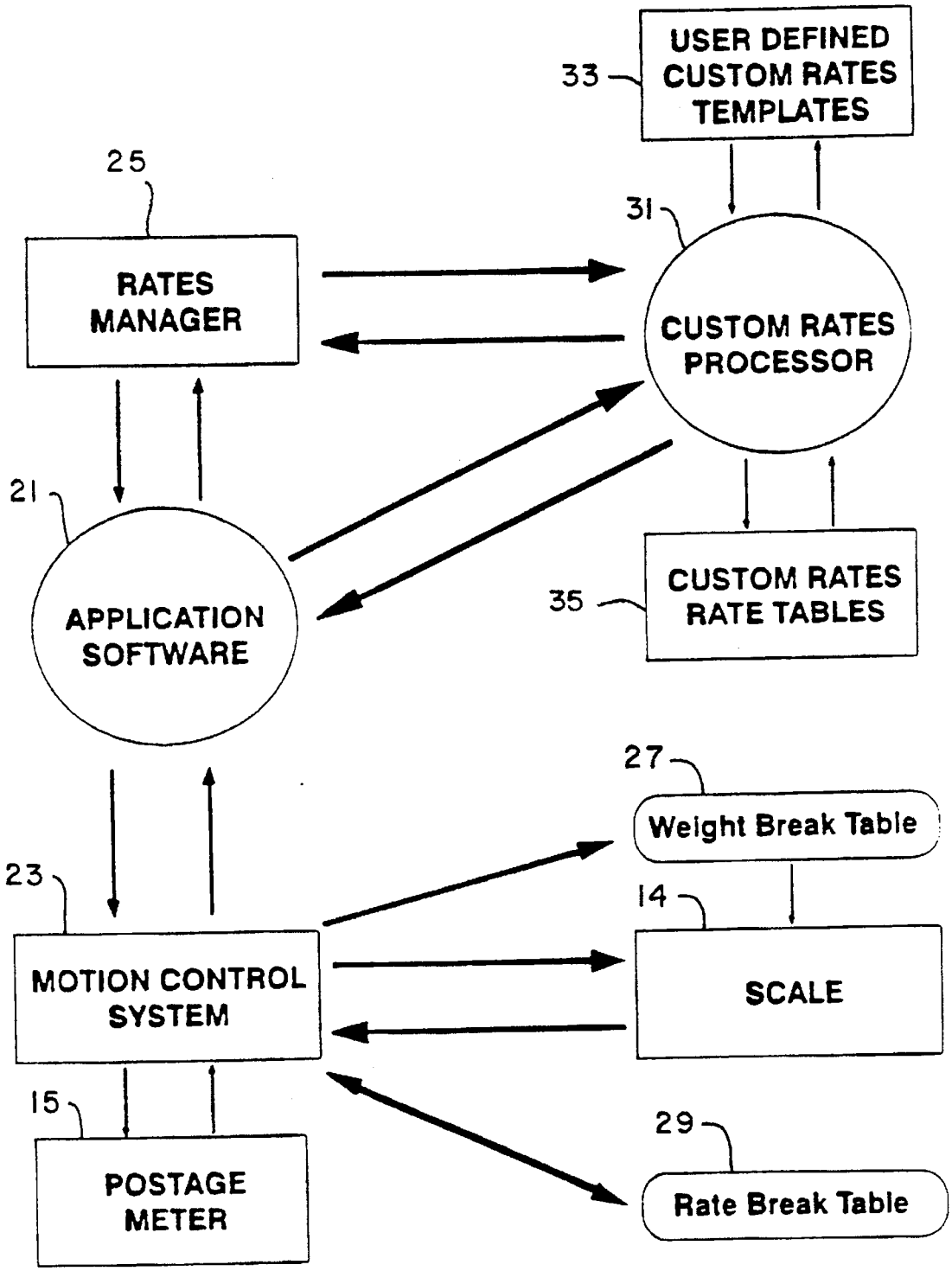
FIG. 2 is a logical block diagram depicting the organization of the software and the relationship thereof to certain hardware elements of the mail processor useful in explaining the present invention.

The software shown in FIG. 2 includes a basic application software module 21 and an associated motion control module 23 which together control the functions of the mail processor 10. The motion control system interacts with the scale 14 and the postage meter 15 to control the actual weighing and postage printing operations.

A rates manager submodule 25 stores the published standard rate tables and supplies information from those tables to other elements of the system on an as needed basis. The rates manager 25 contains rate tables corresponding to the postage rates for all classes of mail, as published by the postal authority, as well as a processing engine to provide appropriate access to the data in the tables as discussed more fully below. In the PARAGON Mail Processor, the rates manager is a software submodule. Of particular note, the rate information supplied by the rates manger 25 is always valid postal rate information for actual postage rates specified by the postal authority. Use of data from those tables effectively prevents a user from tampering with the postage rates established by the postal authority.

Within each class, the postal regulations typically apply a flat fee postage amount to pieces of mail falling within a particular weight range. A weight break table 27 is associated with the scale 14. This table is loaded with data specifying break points defining weight ranges download from a selected standard rate table or custom rates rate table. The scale 14 uses the break point information from the table 27 to classify a piece of mail, by weight, into a particular weight range.

The weight break points may vary for different classes of mail. If a standard class is selected, the application software 21 and the motion control system 23 download breakpoint information from the rate manager 25 into the weight break table 27 for the selected class. If a custom operation is selected, the application software 21 and the motion control system 23 download breakpoint information from a custom rates rate table, as discussed in more detail below. Effectively, the scale 27 provides an index pointer value indicating the range encompassing the weight of a piece of mail, based on the current set of break points in table 27.

The motion control system 23 also uses a rate break table 29 as part of the control of the operation of the postage meter 15. The rate break table translates weight range index values from the scale 14 into monetary postage values from the currently selected standard rate table or custom rates rate table, and the postage meter 15 applies the appropriate monetary values to the pieces of mail passing through the mail processor 10.

In operation, if a standard class is selected, the application software 21 and the motion control system 23 download breakpoint information from the rate manager 25 into the rate break table 29 for the selected class. Similarly, if a custom operation is selected, the application software 21 and the motion control system 23 download breakpoint information from a custom rates rate table, as discussed in more detail below.

In the preferred embodiment, the software modules discussed above, such as the application software 21, the motion control system 23, the rates manager 25 and the break tables 27, 29, may be software elements of the PARAGON Mail Processor. In accord with the present invention, the software of the mail processor includes three custom rates components. More specifically, the software shown in FIG. 2 includes a custom rates processor module 31, user defined custom rates templates 33, and custom rates rate tables 35.

Figure 3:
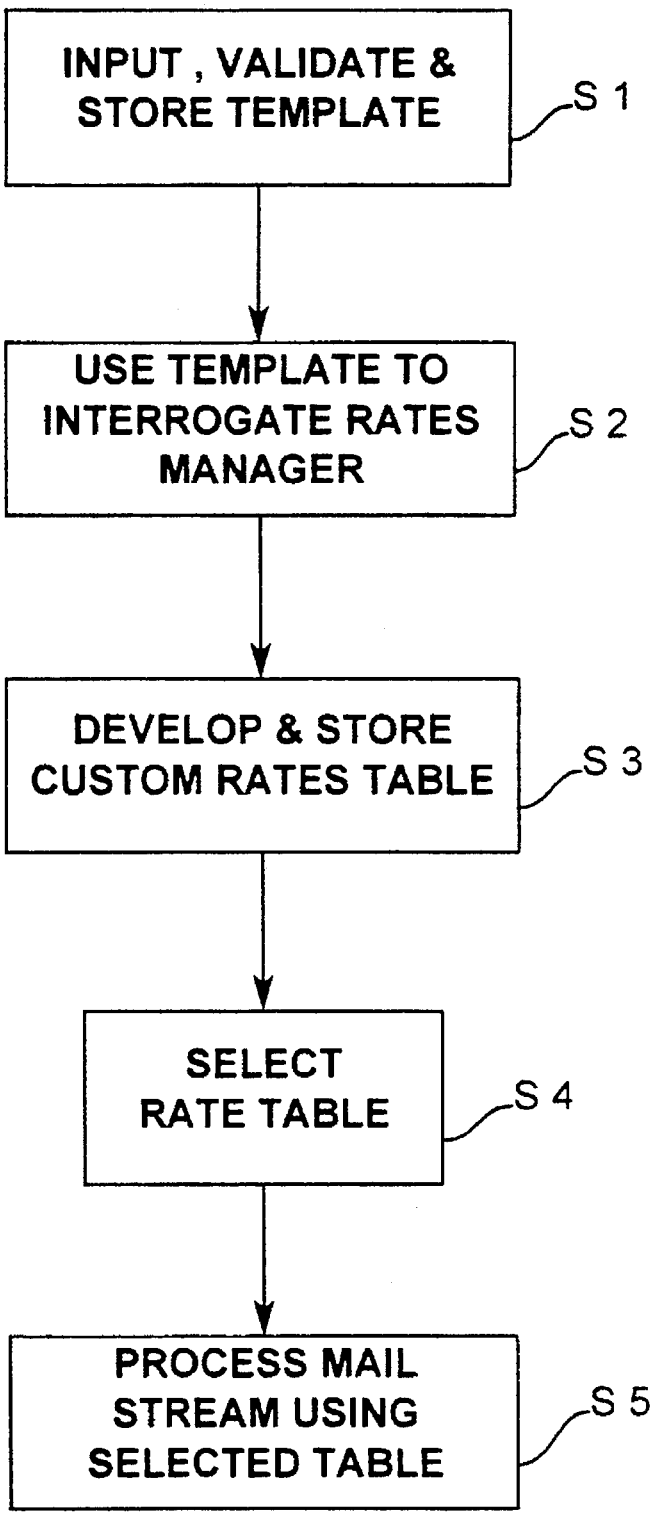
FIG. 3 is a flow diagram, useful in explaining the custom rates processing in accord with the present invention.

FIG. 3 is a high-level flow diagram of the overall processing in accord with the present invention. As illustrated at step S1, a user inputs elements defining a custom template. More specifically, a user operates the mail processor keyboard 13 to input one or more customized templates. The custom rates software 31 controls the prompting and interpretation of key activations during this input operation. As part of the associated processing, discussed more later, the mail processor 10 validates the components of the template and stores the validated template.

The resulting user defined template specifies a parameter range for which each selected class processing should apply.

For each of the templates 33, once input and stored, the custom rates processor 31 utilizes the template to develop a corresponding custom rates rate table 35 (step S2). More specifically, the custom rates processor 31 interrogates the rates manager 25 to obtain break point and postage values for each selected class and range specified in the custom template. From this template, the custom rates processor develops and stores one of the custom rates rate tables 35 (step S3).

The custom rates rate tables 35 are generally similar in format to the rate tables stored in the rates manger 25. A custom rates rate table, however, includes rating information crossing several classes. It should be apparent that the rate information itself is not customized. The rating information supplied by the rates manager 25 and stored in the custom rates rate tables 35 is standard published postage rate information.

In operation, the user selects an established rate table, for purposes of this discussion, one of the stored custom rates rate tables 35 (step S4). The mail processor 10 utilizes the selected rate table to control subsequent processing of a mail stream (step S5). Assuming that the user selected a custom rates rate table, the application software 21 and the motion control system 23 download weight break information into the weight break table 27 from the selected one of the custom rates rate tables 35. The application software 21 and the motion control system 23 also download rate break information into the rate break table 29 from the selected one of the custom rates rate tables 35. The user then begins feeding the mixed (unsorted), multi-class mail stream through the mail processor 10. For each piece of mail in the stream, the scale 14 generates a weight range index value based on the measured weight of the piece of mail, i.e. indicating the range from the table 27 within which the weight of the particular piece of mail falls. The motion control system 23 uses the index value as a pointer to identify a postage value from the rate break table 29. The motion control system 23 then instructs the postage meter 15 to apply the postage value from the rate break table 29 to the particular piece of mail and debit the remaining electronic cash value stored in the meter by the applied amount of money.

If a first piece of mail has a weight in a range corresponding to a first class in the selected custom rates rate table, then the mail processor applies the appropriate rate for mail of the measured weight within that class. If a second piece of mail in the same input stream has a weight in a range corresponding to a second class in the selected custom rates rate table, then the mail processor applies the appropriate rate for mail of the measured weight within the second class. As such, the mail processor applies standardized postage rates from different mail classes to pieces of mail within a single stream, without the need to manually sort the mail or manually select classes.

To assist in understanding the invention, it may be helpful at this point to consider a specific example. Assume now as a simplified example that there are four different classes of mail, as represented in TABLE 1 below.

TABLE 1

| WEIGHT | CLASSA | CLASSB | CLASSC | CLASSD |
|---|---|---|---|---|
| weight1 | rateA1 | rateB1 | rateC1 | rateD1 |
| weight2 | rateA2 | rateB2 | rateC2 | rateD2 |
| weight3 | rateA3 | rateB3 | rateC3 | rateD3 |
| weight4 | rateA4 | rateB4 | rateC4 | rateD4 |
| weight5 | rateA5 | rateB5 | rateC5 | rateD5 |
| weight6 | rateA6 | rateB6 | rateC6 | rateD6 |

Every weight X will have a corresponding rate YX for every class. The rate tables administered by the rates manager 25 can be considered as defining separate weight-to-rate translation tables for each of the classes, albeit derived from the information in TABLE 1. For example, for class A, the weight column specifies six weight breaks and six corresponding rates A1 to A6. For pieces of mail up to weight1, the table for class A will specify a rate of A1. If class A is first class mail, for example, mail of weight less than 1 ounce is subject to a postage rate of $0.32. Similarly, for pieces of mail up to weight2, the table for class A will specify a rate of A2, for pieces of mail up to weight2, the table for class A will specify a rate of A2, etc. If the operator of the mail processor 10 selects one of the standard class rate tables for classes A, B, C and D, then the mail processor 10 will apply postage rates from that table to all input pieces of mail.

In accord with the present invention, assume in the example that the user inputs a custom rates template. As a specific example assume that the user selects a template as follows:

TABLE 2

| WEIGHT | CLASS | MEANING |
|---|---|---|
| weight2 | class A | process all mail up to weight2 as class A |
| weight4 | class B | process all mail up to weight4 as class B |
| weight6 | class C | process all mail up to weight6 as class C |

In the illustrated example, the user selects class A for mail of a weight up to unit 2. The user selects class B for mail of a weight from 2 up to 4, and The user selects class C for mail of a weight from 4 up to 6. In the simplified example, the break points between classes correspond to break points within the classes. However, the user may select arbitrary break points, that bear no specific relationship to any limits defined within specific classes. For example, the middle weight break point in TABLE 3 could be weight4.2.

After input of the template, the custom rate processor 31 interacts with the rates manager 25, as outlined above, to develop a custom rates rate table 31 corresponding to the template. In the current example, this results in a custom rates rate table as set forth in TABLE 3 below:

TABLE 3

| WEIGHT | CUSTOM CLASS | MEANING |
|---|---|---|
| weight1 | rateA1 | class A rate for weight1 |
| weight2 | rateA2 | class A rate for weight2 |
| weight3 | rateB3 | class B rate for weight3 |
| weight4 | rateB4 | class B rate for weight4 |
| weight5 | rateC5 | class C rate for weight5 |
| weight6 | rateC6 | class C rate for weight6 |

Every weight X again will have a corresponding rate YX for every class. However, the one custom rates rate table includes information for several classes taken from the separate information or table for each class as administered by the rates manager 25. For any piece of mail of a weight below weight1, e.g. below 1 ounce, the custom rates rate table specifies class A and a postage value A1 for class A type mail, that is $0.32 from the earlier example. For any piece of mail of a weight between weight1 and weight2, e.g. between 1 and 2 ounces, the custom rates rate table specifies class A and a second postage value A2 for class A type mail. For any piece of mail of a weight between weight2 and weight3, e.g. between 2 and 3 ounces, the custom rates rate table specifies class B and a postage value B3 for class B type mail. For any piece of mail of a weight between weight3 and weight4, the custom rates rate table specifies class B and another postage value B4 for class B type mail. As shown above, the custom rates rate table specifies similar weight index-to-rate information for the higher weight breaks.

If the operator of the mail processor 10 selects one of the custom rates rate table, the break tables 27 and 29 are loaded with appropriate break point information. As a result, the processor 10 will apply postage rates from the selected custom rates table to all input pieces of mail. The processor will apply different class postage rates to different pieces of mail in the stream based on the current value of a particular parameter, in this case the weight of each piece of mail. The applied rates, however, will be standardized rates for the respective classes.

The custom rates processor 31 also interacts with the rates manager 25 and the application software to control the user interface through the keyboard 13 and display 12 during input of a custom rates template. Through this interaction, the CPU 11 will generate a series of prompts, receive a series of class and parameter selection inputs, validate those inputs and store valid inputs as components of a new template.

In a typical input scenario, the mail processor 10 presents a main menu on the display 12. One selection on the menu is for custom rates template input. When the user selects that option, the CPU 10 presents a prompt on the display 12 asking for input of a first class selection.

The display may also offer the user options relating to appropriate classes. Assuming that the parameter defining the break points between classes relates to weight, the first selected class would cover mail having a weight in a range from 0 to a first limit or break point value. The prompt for class selection therefore could indicate one or more classes providing postage for mail in that low weight range.

In response to the displayed prompt, the user selects a first one of the available classes. To input the template in the example discussed above, the user would select class A.

The CPU then drives the display 12 to produce a prompt for input of an upper limit of the range for processing in the selected class, an upper weight in the present example. At this point, the display may indicate the permissible upper limit of the selected class as defined by the postal authority.

The user next inputs a selected upper limit for the controlling parameter, e.g. the upper weight limit. In the above discussed example, the operator would input a value for weight2, e.g. 2 ounces or 2.5 ounces, etc. At this point in the process, the custom rates software 31 interacts with the rates manager 25 to determine if the weight range defined by the selected upper limit is valid for the selected class. If not valid, the processor 10 provides an appropriate notice on the display 21 and then repeats the prompt for input of an upper limit. If valid, the customer rates processor 31 stores the class and upper limit value as a portion of a new one of the templates 33.

In the example, the custom rates software 31 and the rates manager 25 determine whether or not the selected class A applies to mail of weight up to weight2. It was originally assumed that class A applied to all weights up to weight6, including weights from 0 to weight2 (TABLE 1 supra), therefore the selection of class A as the first class and the upper limit of weight2 is valid. The customer rates processor 31 therefore stores the identification of class A, as the first class and an upper limit value of weight2 in the new one of the templates 33.

The mail processor 10 repeats the sequence of prompt for class selection, receive class selection, prompt for upper limit, receive upper limit input, validate class and limit inputs and store valid inputs in the template, for each class selection that the user desires to include in new custom rates template until the user indicates that the template is complete. For the above example of a template shown in TABLE 2, the process would continue as the user input the three class selections and the three corresponding weight limits. In the presently preferred embodiment using the PARAGON Mail Processor hardware, the custom rates software permits a user to specify up to four different classes and corresponding weights, for each new custom rates template.

When the user has completed to process of inputting the definition of the template, the mail processor provides a prompt on display 12 asking for a screen name to identify the new template. The user inputs a name, up to some maximum number of characters in length, and the CPU stores the name in memory as an identifier of the new template and of the associated custom rates rate table 35.

After completion of the template input procedure, the full template resides in storage as one of the user defined templates 33. As noted above, the custom rates processor 31 utilizes the template to obtain actual rate information from the postal rate tables administered by rates manager 25 and thereby develop a corresponding custom rates rate table, such as that shown in TABLE 3 above.

By the above process, a user can define one or more custom rates templates 33 and a corresponding number of custom rates rate tables 35. Each such custom rates rate table 35 is identified by a corresponding user defined screen name. During operation of the mail processor 10, the operator can select rate tables to apply for processing of an input mail stream. For this purpose, the processor presents a list of available rate tables on the display 12.

The displayed list includes all of the standard postal rate classes, classes A, B, C and D in the above example. The displayed list also includes the names of all of the currently available custom rates rate tables 35. The user simply selects a table by name from the displayed list, either a standard table or a custom rates rate table, and the mail processor 10 processes all pieces of input mail in accord with the rate table corresponding to the selected table name.

At any time, if the postal authority changes the rates for any of the classes, the postal authority provides information to update the rate tables in the rates manager 25 in the normal manner. Subsequently, if the user so desires, the custom rates processor 31 can again validate the template, and if valid, utilize the template to form an updated custom rates rate table. Alternatively, the user may choose to modify the template or replace the template with a new version, and the custom rates processor 31 will utilize the modified or new version of the template to form the updated custom rates rate table.

While the foregoing has described what are considered to be preferred embodiments of the invention, it is understood that various modifications may be made therein and that the invention may be implemented in various forms and embodiments, and that it may be applied in numerous applications, only some of which have been described herein. It is intended by the following claims to claim all such modifications and variations which fall within the true scope of the invention.

We claim:

1. A method comprising:

storing a user input of a first mail class selection and a first parameter value;

storing a user input of a second mail class selection and a second parameter value;

obtaining first postage rate information from a standard postage rate table, the first postage rate information relating to postage applicable to mail processed in the first mail class and having a parameter within a range defined at least in part by the first parameter value;

obtaining second postage rate information from a standard postage rate table, the second postage rate information relating to postage applicable to mail processed in the second mail class and having a parameter within a range defined at least in part by the second parameter value;

storing the first and second postage rate information as a custom rates rate table; and processing a stream of a plurality of pieces of mail in the first and second mail classes using the custom rates rate table.

2. A method as in claim 1, wherein the step of processing comprises:

applying postage based on the first postage rate information to a first piece of mail in the stream which has a measured parameter in the range defined at least in part by the first parameter value; and applying postage based on the second postage rate information to a second piece of mail in the stream which has a measured parameter in the range defined at least in part by the second parameter value.

3. A method as in claim 1, wherein each storing step comprises:

providing a display prompting the user to input a class selection and a corresponding parameter value; and validating each said input class selection and corresponding parameter value based on a standard postage rate table.

4. A method as in claim 1, wherein each parameter value relates to weight of pieces of mail.

5. An automated mail processing method comprising:

storing a user defined template, said user defined template specifying a plurality of mail classes and a corresponding parameter value for each specified mail class;

accessing standard postage rate information for each specified class, wherein for each respective specified mail class the accessed postage rate information relates to postage applicable to mail in the respective mail class and having a parameter within a range defined at least in part by the corresponding parameter value;

storing the accessed postage rate information as a custom rates rate table; and processing a stream of a plurality of pieces of mail in the plurality of mail classes using the custom rates rate table.

6. A method as in claim 5, wherein the step of storing comprises:

receiving class selections and corresponding parameter values;

determining validity of the class selections and corresponding parameter values based on the standard postage rate information; and storing validated class selections and corresponding parameter values.

7. A method as in claim 5, wherein the step of processing comprises:

measuring a value of a characteristic parameter of each piece of mail; and applying postage rate information for the plurality of classes to the pieces of mail based on a relationship of the measured value of the characteristic parameter to the ranges defined by the corresponding parameter values.

8. A method as in claim 5, wherein each parameter value relates to weight of pieces of mail.

9. An automated mail processing method comprising:

storing a postage rate table for each of a plurality of mail classes;

storing a user defined template, said user defined template specifying at least two of the mail classes and a corresponding parameter value for each specified mail class;

accessing postage rate information in the stored postage rate table for each specified mail class, wherein for each respective specified mail class the accessed postage rate information relates to postage applicable to mail in the respective mail class and having a parameter within a range defined at least in part by the corresponding parameter value;

storing the accessed postage rate information as a custom rates rate table;

receiving a selection of one of the stored rate tables;

if the selected stored rate table is one of the postage rate tables, processing a stream of a plurality of pieces of mail to apply postage corresponding one mail class; and if the selected stored rate table is the custom rates rate table, processing a stream of a plurality of pieces of mail in the specified mail classes using the custom rates rate table.

10. A method as in claim 9, wherein each step of processing a stream of a plurality of pieces of mail comprises:

loading a weight break table with weight break point information from the selected stored table;

loading a rate break table with postage fee values corresponding to weight ranges between weight break points from the selected stored table;

weighing pieces of mail and providing index values identifying ranges of weight for pieces of mail based on the break points stored in the weight break table; and in response to the index values, applying postage values from the rate break table to the pieces of mail.

11. A method as in claim 9, wherein the step of storing a user defined template comprises:

receiving class selections and corresponding parameter values;

determining validity of the class selections and corresponding parameter values based on the standard postage rate information; and storing validated class selections and corresponding parameter values.

12. A method as in claim 9, wherein each parameter value relates to weight of pieces of mail.

13. An automated mail processing method comprising:

storing a postage rate table for each of a plurality of mail classes;

storing a user defined template, said user defined template specifying at least two of the mail classes and a corresponding parameter value for each specified mail class;

accessing postage rate information in the stored postage rate table for each specified mail class, wherein for each respective specified mail class the accessed postage rate information relates to postage applicable to mail in the respective mail class and having a parameter within a range defined at least in part by the corresponding parameter value;

storing the accessed postage rate information as a custom rates rate table;

receiving a user selection of the custom rates rate table, and in response, processing a first stream of a plurality of pieces of mail in the specified mail classes using the custom rates rate table; and receiving a user selection of one of the stored postage rate tables, and in response, processing a second stream of a plurality of pieces of mail to apply postage corresponding one mail class.

14. A method as in claim 13, wherein the step of storing a user defined template comprises:

receiving class selections and corresponding parameter values;

determining validity of the class selections and corresponding parameter values based on the standard postage rate information; and storing validated class selections and corresponding parameter values.

15. A method as in claim 13, wherein each parameter value relates to weight of pieces of mail.

16. A mail processor comprising:

a scale for weighing pieces of mail;

a postage meter for applying postage values to individual pieces of mail;

a central processing unit controlling operation of the scale and postage meter;

a user interface coupled to the central processing unit; and a memory storing software controlling operation of the central processing unit, wherein the stored software comprises:

(1) a weight break table loadable with data specifying weight indexes used by the scale to classify pieces of mail into weight ranges;

(2) a rate break table loadable with data translating weight ranges into postage values;

(3) a rates manager module administering stored rate tables containing standard postage rate information for a plurality of mail classes;

(4) a custom rates processor module;

(5) at least one user defined custom rates template specifying at least two of the mail classes and a corresponding parameter value for each specified mail class;

(6) at least one custom rates rate table developed by an interaction of the custom rates processor module and the rates manager to access postage rate information in the stored rate table for each specified mail class, wherein for each respective specified mail class the accessed postage rate information relates to postage applicable to mail in the respective mail class and having a parameter within a range defined at least in part by the corresponding parameter value; and an application software module, responsive to a user selection of any one of the stored tables for loading information from the selected any one of the stored tables into the weight break table and the rate break table to control subsequent processing of pieces of mail.

17. A mail processor in claim 16, wherein the user interface comprises:

a display for prompting a user to input class selections and corresponding parameter values defining the template and for displaying a list of the stored tables available for selection; and a keyboard for user input of class selections and corresponding parameter values and input of the user selection of any one of the stored tables.

* * * * *